US006140930A

United States Patent [19]

Shaw

[11] Patent Number: 6,140,930

[45] Date of Patent: Oct. 31, 2000

[54] CRANE SAFETY DEVICES AND METHODS

[76] Inventor: Jack B. Shaw, 2710 Bedford St., Johnstown, Pa. 15904

[21] Appl. No.: 09/030,249

[22] Filed: Feb. 25, 1998

Related U.S. Application Data

[60] Provisional application No. 60/039,825, Feb. 27, 1997.

[51] Int. Cl.[7] ..... G08B 21/00

[52] U.S. Cl. ..... 340/685; 212/276

[58] Field of Search ..... 340/685, 686.1, 340/686.6, 692; 212/155, 223, 231, 276, 281; 294/82.11, 82.15

[56] References Cited

U.S. PATENT DOCUMENTS

| | | | |
|---|---|---|---|
| 3,815,116 | 6/1974 | Fink | 340/685 |
| 3,823,395 | 7/1974 | Rigney et al. | 340/685 |
| 3,969,714 | 7/1976 | Greer | 340/267 C |
| 4,178,591 | 12/1979 | Geppert | 340/685 |
| 4,183,708 | 1/1980 | Kuhbier et al. | 414/543 |
| 4,238,037 | 12/1980 | Azovtsev et al. | 212/149 |
| 4,300,134 | 11/1981 | Paciorek | 340/685 |
| 4,303,973 | 12/1981 | Williamson, Jr. et al. | 364/103 |
| 4,516,117 | 5/1985 | Couture et al. | 340/685 |
| 4,752,012 | 6/1988 | Juergens | 212/154 |
| 4,833,615 | 5/1989 | Bitner et al. | 364/463 |
| 4,849,778 | 7/1989 | Samuelson | 354/81 |
| 5,019,798 | 5/1991 | Pherigo, Jr. | 340/326 |
| 5,042,959 | 8/1991 | Tadatsu | 405/191 |
| 5,058,752 | 10/1991 | Wacht et al. | 212/150 |
| 5,067,013 | 11/1991 | Lindholm et al. | 358/93 |
| 5,089,972 | 2/1992 | Nachman et al. | 364/478 |
| 5,198,800 | 3/1993 | Tozawa et al. | 340/573 |
| 5,211,245 | 5/1993 | Relyea et al. | 169/24 |
| 5,217,126 | 6/1993 | Hayashi et al. | 212/153 |
| 5,353,400 | 10/1994 | Nigawara et al. | 395/161 |
| 5,400,246 | 3/1995 | Wilson et al. | 364/146 |
| 5,517,404 | 5/1996 | Biber et al. | 364/138 |

FOREIGN PATENT DOCUMENTS

| | | |
|---|---|---|
| 0 008 210 A1 | 2/1980 | European Pat. Off. . |
| 0 614 845 A2 | 9/1994 | European Pat. Off. . |
| 7-81887 | 3/1995 | Japan . |
| 2 050 294 | 1/1981 | United Kingdom . |
| WO 85/05614 | 12/1985 | WIPO . |

*Primary Examiner*—Brent A. Swarthout
*Assistant Examiner*—Toan Pham
*Attorney, Agent, or Firm*—Banner & Witcoff, Ltd.

[57] ABSTRACT

An improved crane warning system which includes acceleration sensors, motion sensors, hydraulic sensors, remote communications and/or a camera. The crane warning system may include a crane warning device integrated into the ball of the crane.

15 Claims, 7 Drawing Sheets

CRANE SAFETY DEVICES AND METHODS

This application claims the benefit of U.S. Provisional Ser. No. 60/039,825 filed Feb. 27, 1997.

TECHNICAL FIELD

The present invention relates to crane safety methods and devices and, in particular, to improved safety devices and methods which warn workers of the movement of portions of a crane.

BACKGROUND OF THE INVENTION

Conventional crane safety devices (e.g., U.S. Pat. No. 5,019,798) are subject to a number of deficiencies. For example, the devices must be manually attached to the load each time that a new load is secured to the crane. Further, a warning beacon on the safety device often becomes obscured by the load, especially where the load is large or of an unusual shape. Further, the warning indicators on the device are always active whether or not the load is actually in motion. This condition is dangerous because it does not sufficiently warn the workman when the ball is in motion. Because of these disadvantages, crane safety devices mounted proximate to the moving crane parts have not been widely utilized. Accordingly, there is a need for an improved crane safety device.

SUMMARY OF THE INVENTION

One aspect of the invention is to provide an acceleration sensor within the crane warning device which activates the crane warning device whenever the ball of the crane is being accelerated in any direction. For example, a mercury switch, a piezo-electric sensor, or other conventional acceleration sensor may be utilized to determine when the ball of the crane is accelerating.

Another aspect of the invention is to include a sensor which detects constant velocity motion of the ball of the crane. This sensor may be utilized in addition to or instead of the acceleration detector coupled to the ball of the crane. The motion sensor may be wholly contained within a housing of the warning device or it may be distributed at other locations in the crane such as by coupling portions of the warning device to one or more other electro-mechanical components of the crane. In one aspect of the invention, portions of the motion sensor are coupled to one or more hydraulic systems in the crane and actuated appropriately whenever the hydraulic system is actuated to move the ball of the crane. In yet other aspects of the invention, portions of the motions sensor are coupled to the electronic control system of the crane. In still other aspects of the invention, the mechanisms for detecting motion are mounted remotely and communicate with the warning device using electromagnetic waves such as radio waves.

In yet other aspects of the invention, fail-safe mechanisms may be built into the crane warning device such that the warning device is activated whenever a sensor fails or loses contact (e.g., radio contact) with the warning device. Further, a crane warning device status monitor may be built into the cabin of the crane so that the operator may be warned of any operational problems with any of the sensors in a timely fashion.

In still further aspects of the invention, the crane warning device may be mounted to maximize its utilization and resulting safety such as by integrating the crane warning device directly into the ball of the crane. In still further aspects, the warning device may be removably or fixedly attached to the side of the crane (e.g., by bolting or magnetically attaching the device to one or more sides of the counter weight).

In still further aspects of the invention, multiple crane warning devices are coupled to the crane in different locations so as to maximize safety. For example, one crane warning device may be located on the ball, and second, third, and/or fourth crane warning devices respectively mounted on first, second, and third sides of the crane counter weight. In yet other aspects of the invention, the audible and visual warning indicators from all of the crane warning devices may be synchronized such that the "beep" noise and/or the strobe light from all of the crane warning devices are coincident.

In still further aspects of the invention, a microphone and speaker system is included in the crane warning device such that the operator can communicate with the workers. Worker safety is vastly increased because the worker may use both hands to manipulate the load while verbally signaling the operator. In further aspects of the invention, the a camera may be mounted such that a "birds eye" view of the load/ball may be obtained by the operator sitting in the cab from a remotely mounted camera. The birds eye view, alone or in conjunction with the audio communications, vastly increases safety and efficiency of the crane operating environment. Additionally, in other aspects of the invention, electronics in the warning device may electronically filter the noise from the crane audible warning device so as not to interfere with normal communication with the crane operator. The filtering eliminates the beeping emitted from the warning device without filtering out the normal voice of the operator and/or worker. In still further aspects of the invention, the crane warning devices are mounted on different sides of the crane so that the operator has immediate communications with all sides of the crane, further enhancing safety.

Although the invention has been defined using the appended claims, these claims are exemplary and not limiting in that the invention is meant to include one or more elements from the apparatus and methods described herein in any combination or subcombination. Accordingly, there are any number of alternative combinations for defining the invention, which incorporate one or more elements from the specification (including the drawings) in various combinations or subcombinations.

DESCRIPTION OF PREFERRED EMBODIMENTS

Figure 1:
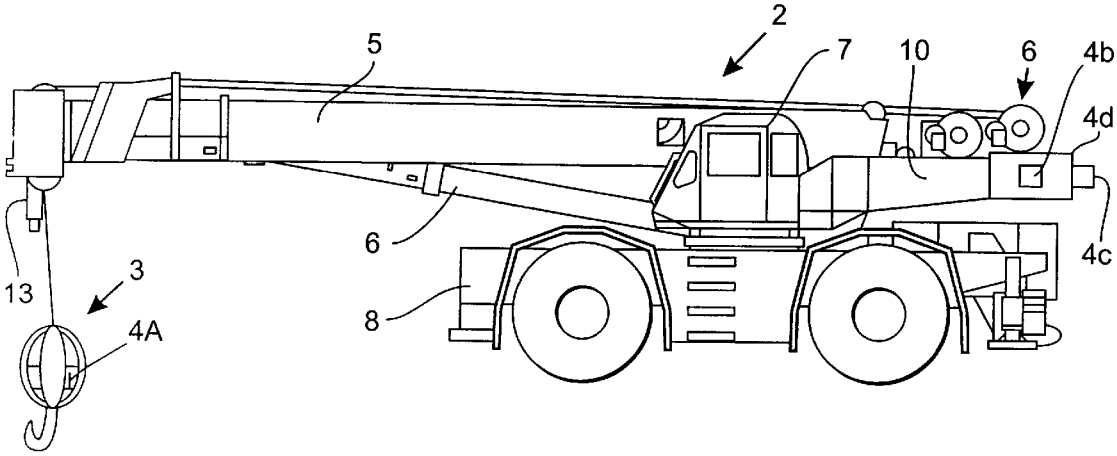
FIG. 1 is a perspective view of a crane incorporating aspects of the crane warning system.
Figure 2:
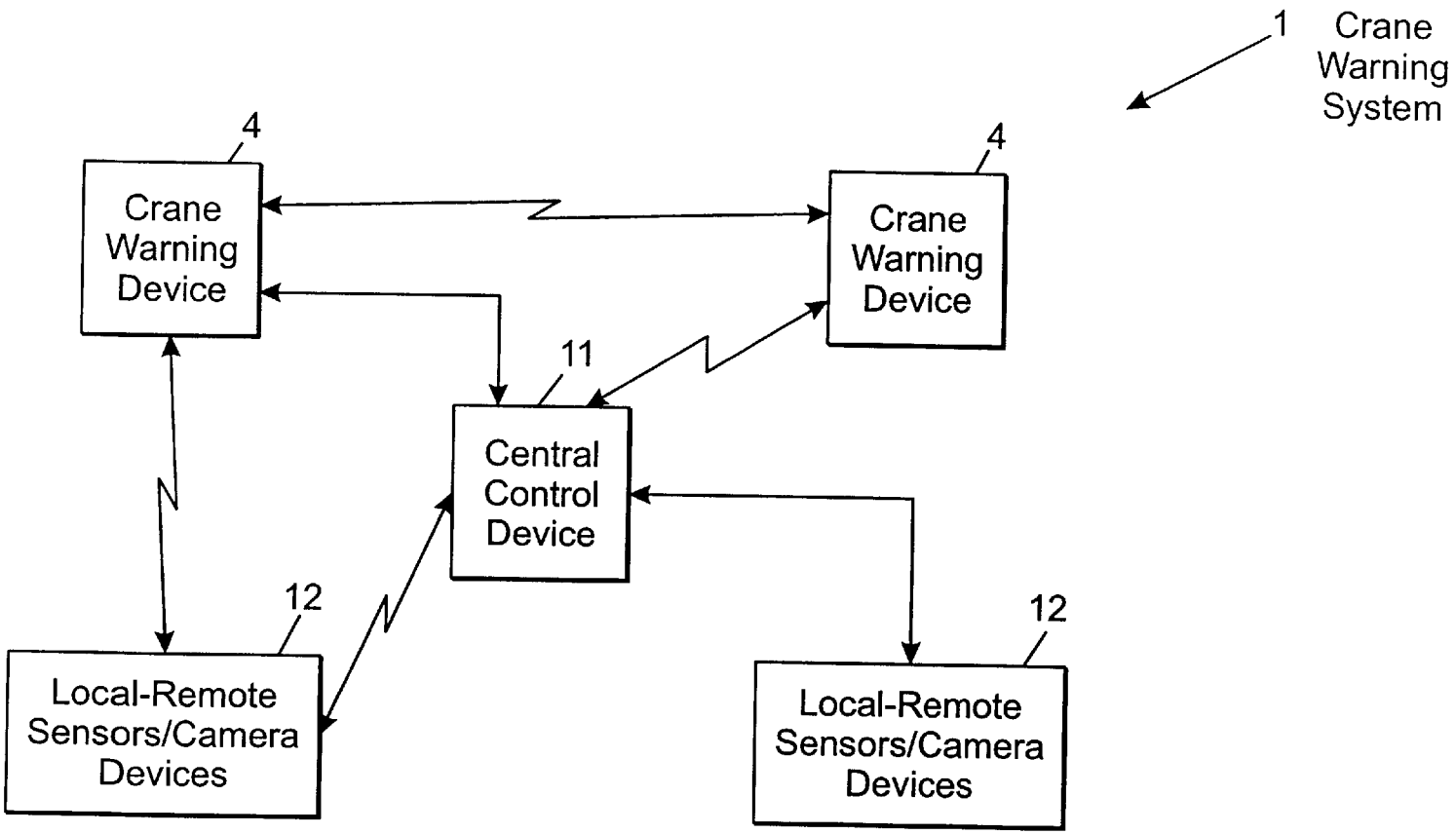
FIG. 2 is a block diagram of a crane warning system incorporating a plurality of crane warning devices, a central control device, and a plurality of remote sensors.

Referring to FIGS. 1 and 2, a crane warning system 1 is incorporated in a crane 2 to improve the safety of workers (not shown) in the vicinity of the crane. The crane 2 typically includes a boom 5, various movement mechanisms 6 to move the boom 5 and/or ball 3 in any one of a plurality of direction. The movement mechanisms may include any hydraulic, electromotive, mechanical, and/or other mechanisms well known in the art to cause motion of the ball 3. For the purposes of this specification, the boom includes any jib or other extension which may be attached to the boom. The crane 2 typically includes a cab 7 for accommodating an operator (not shown). In many cases, the cab 7 is either partially or completely enclosed to provide a controlled environment for the operator. The crane 2 may include one or more crane warning devices 4 strategically disposed about the crane 2. In the embodiment shown in FIG. 1, the crane warning device 4A is incorporated directly into the ball 3 of the crane 2. Alternatively, the crane warning device 4 may be located at other strategic locations such as on the counter weight 10. In the embodiment illustrated in FIG. 1, there are three crane warning devices **4*b* located on three different sides of the counter weight 10**.

Disposing a crane warning device on the crane counter weight is particularly advantageous where the crane is used in an urban area. Often the crane is positioned in the street adjacent to the sidewalk. Pedestrians are often routed around the crane using orange warning cones. However, in order to keep from being injured by cars, pedestrians often stand within the cones while waiting for cars to pass. These pedestrians are often oblivious to the fact that when the crane turns, a large counter weight also swings out into the street where they are standing. Thus, the crane warning devices **4*b* disposed on the counter weight 10 are particularly advantageous. The crane warning device 4*b*** may be located directly on the counter weight using any suitable method such as bolting, strapping, or magnetic attachment. The crane warning device may also be mounted toward the back of the counter weight so as to be near the portion of the counter weight which extends furthermost from the crane as the counter weight turns.

Referring specifically to FIG. 2, one or more of the crane warning devices 4 may operate in isolation or may be coupled to one or more other devices. Where the crane warning devices 4 are coupled to other devices, they may be coupled to a central control device 11, one or more other crane warning devices 4, and/or one or more remote sensors/camera units 12. Where a central control device 11 is utilized, the central control device 11 may be directly or indirectly coupled to one or more remote sensors and/or camera units 12. The connections between the crane warning devices 4, the central control device 11, and remote sensors and/or camera units 12 may be accomplished using any suitable mechanism such as electromagnetic transmission (e.g., radio waves) and/or direct electrical and/or optical connections.

Where a remote camera 13 is utilized, the remote camera may be mounted in any suitable location such as on the boom, ball, cable, etc. In many embodiments, the remote camera 13 may be mounted such that a birds eye view is presented to the operator in the cab such that the operator can see all around the load and is not restricted to viewing only one side of the load. In this manner, where the worker stands on the far side of the load, the operator can view the workers actions and position relative to the load.

Figure 4:
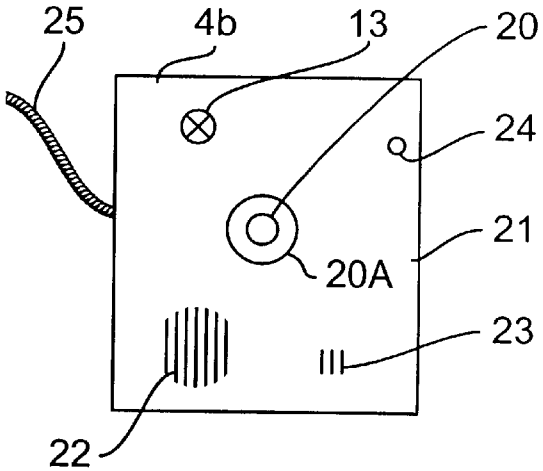
FIGS. 3–5 are perspective views of first, second, and third embodiments of a crane warning devices incorporating aspects of the present inventions.
Figure 3:
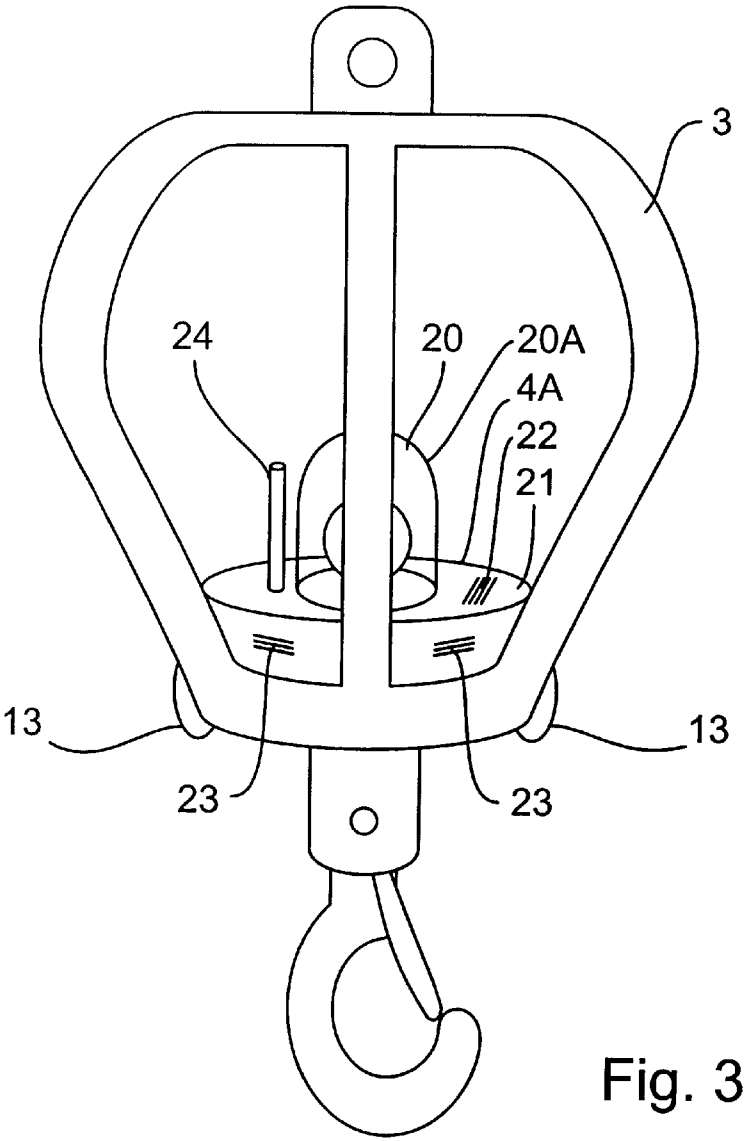
Figure 5:
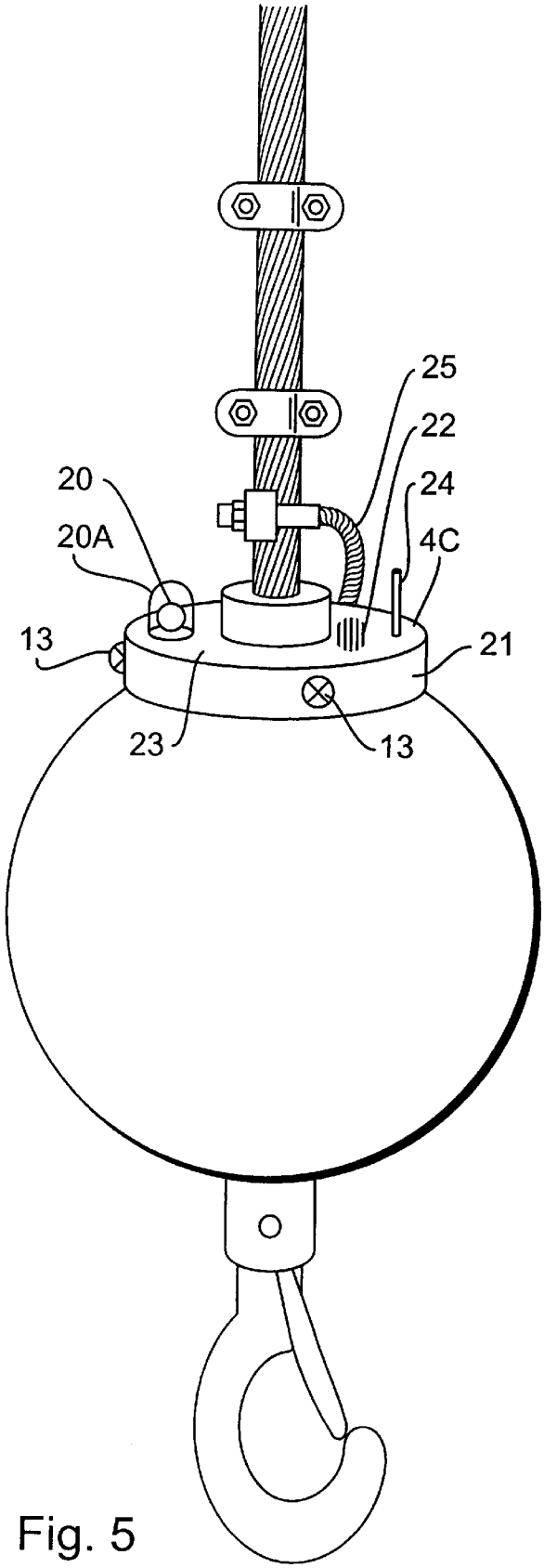

Referring to FIGS. 3–5, three different embodiments of the crane warning device 4 are shown. The crane warning devices 4A, 4B, and 4C may include a beacon light 20, one or more audible warning devices 22 (speakers), one or more audio processor devices 23 (microphones), a transmit/receive mechanism 25 (antenna), a tether 24, and/or one or more remote sensor/camera devices 13 coupled to an enclosure 21. With regard to FIG. 3, the crane warning device 4A is incorporated directly into the ball 3 of the crane 2. Where the crane warning device is integrated into the ball of the crane, visibility of the warning light is maximized and a centralized audible warning noise is advantageously provided to minimize interference of the load with the warning device. When integrated into the ball, the warning device remains visible from substantially all angles, e.g., 360 degrees. With regard to FIG. 4, the crane warning device may be incorporated in an enclosure 21 and mounted about the crane such as on one or more sides of the counterweight 10. In the embodiment of FIG. 5, the crane warning device may be positioned above the ball 3. In the embodiments of FIGS. 4 and 5, it may be desirable to incorporate a magnet into the base of the crane warning device to facilitate attachment to the ball or counterweight of the crane. In this manner, it is a simple task to retrofit cranes with a suitable crane warning device.

Figure 6:
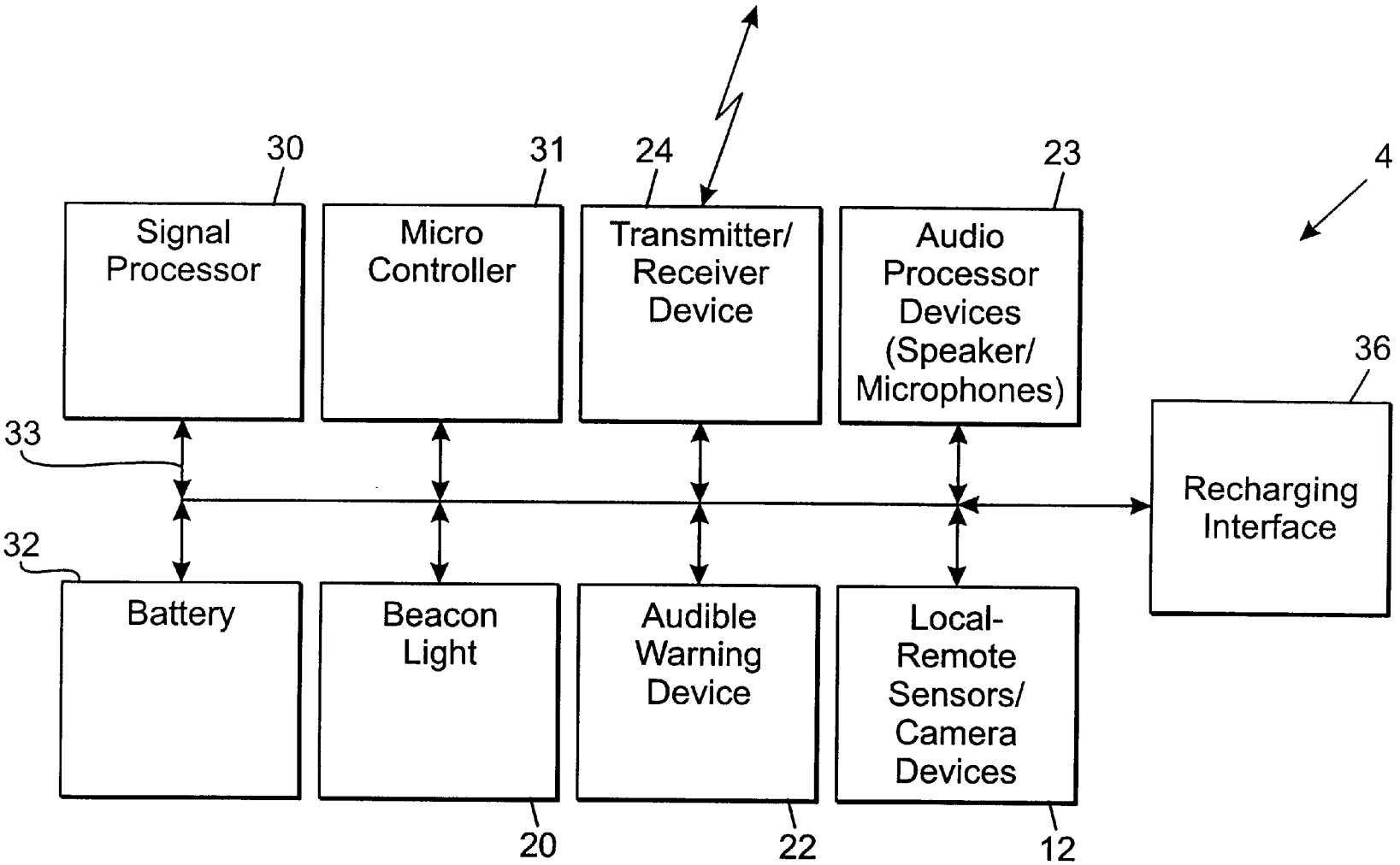
FIG. 6 is a block diagram of an embodiment of the crane warning device.
Figure 7:
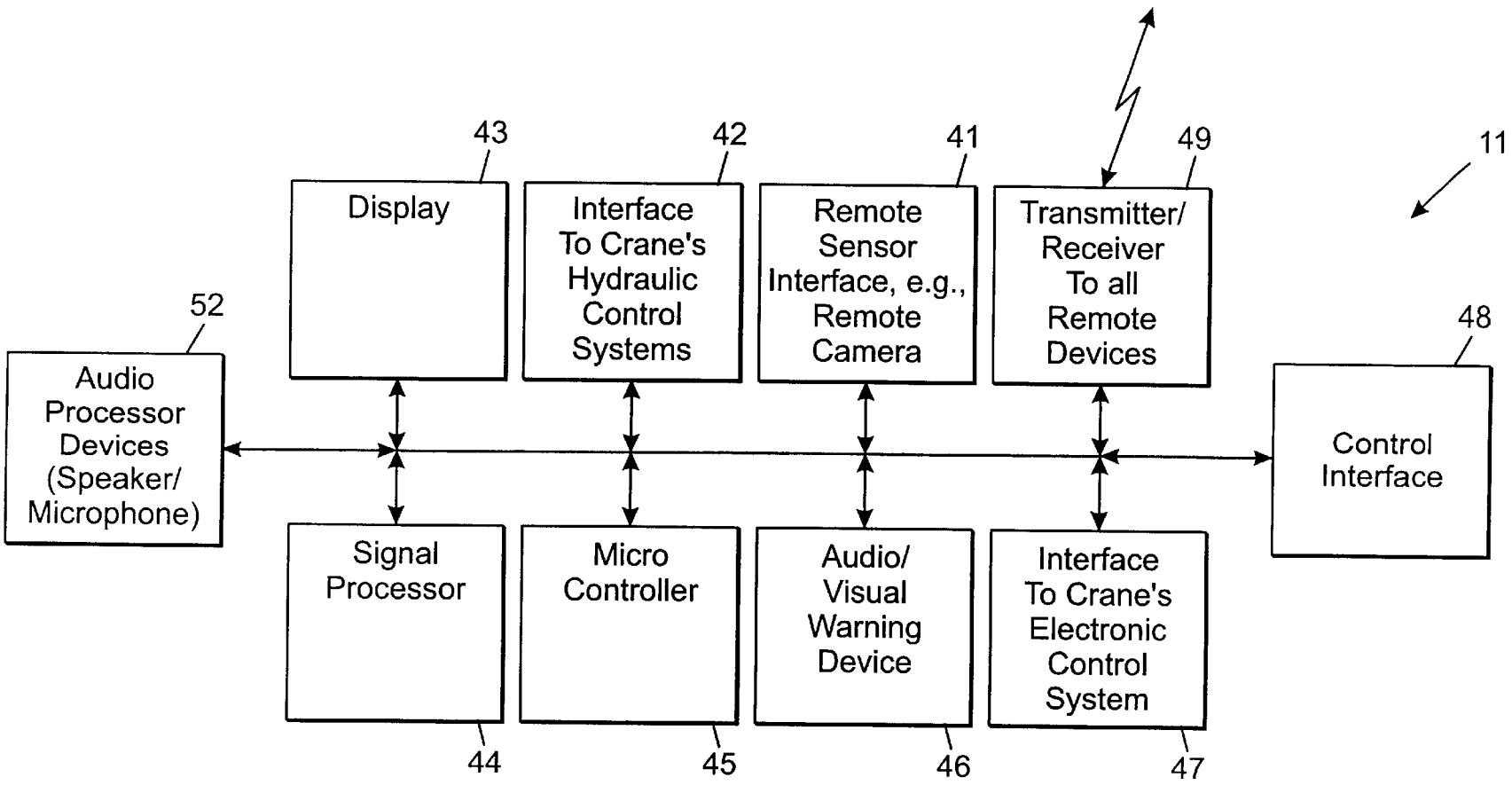
FIG. 7 is a block diagram of a central control device.
Figure 8:
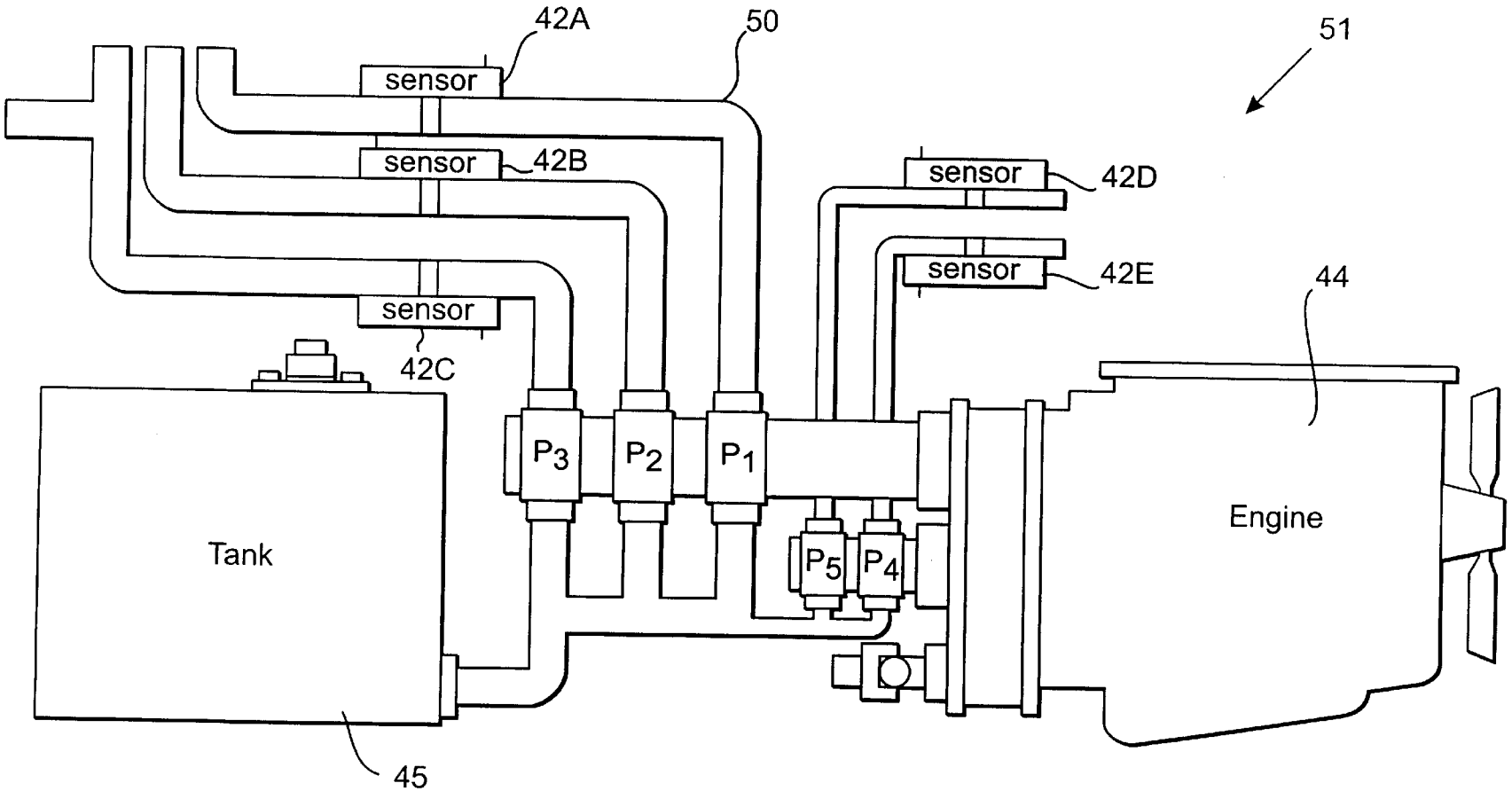
FIG. 8 is a partial schematic, partial block diagram of a remote sensor arrangement coupled to a hydraulic system in the crane.

Referring to FIG. 6, an exemplary block diagram of one embodiment of the crane warning device 4 is shown. The crane warning device may include the beacon light 20, the audible warning device 22, the local and/or remote sensors/camera device 12, the audio processor devices 23, the transmitter/receiver device 24, a signal processor 30, a microcontroller 31, a recharging interface 36, and a battery 32 interconnected via one or more system busses 33. FIG. 7 shows an exemplary block diagram of one embodiment of the central control device 11. The central control device 11 may include a signal processor 44, a microcontroller 45, an audio/visual warning device 46, an interface to the crane's electronic control system 47, a control interface 48, a transmitter/receiver 49, a remote sensor interface 41, a hydraulic control interface 42, and a display 43. FIG. 8 shows an exemplary embodiment of the hydraulic system 51 of the crane 2 where hydraulic sensors 42A–42E are coupled to a hydraulic system incorporating a tank 45, a plurality of pumps P1–P6, an engine 44, and a plurality of hydraulic lines 50. The crane warning devices 4 and the central control device 11 may be variously configured to include any subset of the devices shown in the block diagrams in any subcombination.

The beacon light 20 may be any suitable configuration including a flashing light or a strobe light. In some embodiments, the beacon light 20 may include a protective cover 20A made of a high impact polymer such as a plastic resin. Further, the protective cover 20A or the beacon light 20 may be colored so as to emit a red or orange light. In preferred embodiments, the output of the beacon light 20 is controlled such that the beacon does not interfere with the vision of the workman working in the vicinity of the ball 3. In one exemplary embodiment, the light output is similar to a battery operated road-side flasher. The audible warning device 22 may be variously configured to include any audible warning signal such as the audible warning signal commonly associated with backing movement of a truck. It may be desirable to maintain the volume of the audible sensor within a range which alerts the workman in the vicinity of the ball to movement of the ball but without interfering with normal communications of the workman. In other words, the workman should still be able to speak over the audible warning noise. To facilitate this objective, the beeping noise emitted by the audible warning device may be limited to occur at a rate of only once per second, or ever second or third second. Alternatively, the audible warning noise may be emitted continuously at a particular frequency.

The audible warning device 22 may be used in addition to or instead of the beacon light 20.

The local and/or remote sensors/camera devices 12 may be variously configured. For example, the sensors may include any one of a number of local sensors or remote sensors. In one embodiment, one or more local acceleration sensors are included which detect acceleration of the ball 3 in any one of three dimensions. For example, a vertically and horizontally mounted acceleration sensor may be utilized. The acceleration detector may be any detector known in the art such as a piezoelectric sensor and/or a mercury based sensor. Of these, the piezoelectric based sensor may be more desirable due to the high impact environment often experienced by the ball 3.

There are any number of degrees of freedom for the ball of a crane to move. The ball may move at a constant velocity with no acceleration or with a variable or constant acceleration. For example, the ball may move along the boom on a carriage, or the ball may move as a telescoping boom extends or retracts. The ball may also move as the boom swings right or left or moves up or down. In other words, a ball on a typical crane is capable of total three dimensional movement with either a constant velocity and no acceleration or a variable velocity with acceleration. Thus, an acceleration detector alone will not reliably detect when a crane is in motion. Accordingly, a local motion detector may be included in each of the crane warning devices which uses any suitable technique to detect motion. For example, an ultrasonic ranging system similar to those employed to focus cameras may be utilized. In one exemplary embodiment, one or more ultrasonic ranging sensors may be mounted to detect the ball's relative distance from the boom 5 and/or cab 7. For example, one or more first sensors may be directed towards the boom, and one or more second sensors may be directed toward the cab or out-riggers 8. Further, a plurality of sensors may be located on multiple sides of the ball in the event that the ball twists. In exemplary embodiments, it may be desirable to have two, three, or more motion sensors disposed at spaced locations such that the position of the ball 3 and movement of the ball 3 may be determined at any time via well known triangulation methods. Any number of motion sensors and/or acceleration sensors may be included in the crane warning devices (e.g., mounted entirely within the ball) and/or distributed at various locations about the crane 2 and configured to be in electrical and/or electromagnetic communication with the crane warning devices.

Where remote sensors are utilized, the remote sensors may be coupled to the crane's movement mechanisms 6 and/or the crane's electronic control system 47. For example, each time that the crane's hydraulic system 51 is actuated a signal may be sent from any one of a number of remote sensors 42A–42E to the crane warning devices 4 (either directly or via the central control device 11) activating a warning. Each of the crane warning devices need not be actuated by the same signals/sensors. For example, the crane warning devices 4A, 4C proximate to the ball may be activated whenever cable movement is detected to raise, lower, or swing the cable/boom, whereas the crane warning devices 4*b* proximate to the counter weight 10 may only be activated when the operator initiated a swinging action of the cab such that the counter weight swung left or right. In other words, where multiple crane warning devices are affixed to the crane, each warning device may be under separate control and responsive to some separate sensors and/or some common sensors. Further, the crane warning devices may receive control locally, from the central control device 11, and/or from one or more remote sensors including the camera 13.

The crane warning devices 4 may be synchronized such that the audible and/or visual warnings emitted from the devices occur in unison. This eliminates much of the noise distortion of many warning devices occurring at the same time but skewed from each other or operating at a different frequency. Further, the audible warning emitted from the warning device may change depending on the motion of the crane. For example, where the ball is moving up, a first audio frequency would be emitted; where the ball is moving down, a second audio frequency would be emitted; where the crane is turning left or right, a third audio frequency is emitted, etc. In this manner, regardless of the indication given by the crane operator, the workers would know what motion to expect out of the crane based solely on the noise emitted by the warning device. Additionally, it may be desirable to delay movement of the crane for a relatively short period of time (e.g., one, two, or three seconds) while the audible tone sounds. This allows the workers to have, for example, a fraction of a second notice, before movement of the ball actually takes place.

The local—remote sensors may also include one or more cameras 13. One or more cameras 13 may be mounted directly in the crane warning device 4 using, for example, one or more digitally corrected/concatenated wide angle lens, and/or a camera mounted on the boom to obtain a birds eye view of the workers and ball. For the wide angle lenses, digital correction techniques and techniques to concatenate the various image views (e.g., to form a 360 degree view) are well know in the art. The visual indication provides the operator with additional information as to the position of the load, ball and workers. Where the camera is mounted on the boom, the camera 13 may include a fixed and/or adjustable zoom control which enables the operator to view the work up-close. Where the zoom of the camera in under operator control, the control is via one or more remote switches located in the cab such as on control interface 48. The display from the camera 13 is preferably shown on display 43. Where more than one remote camera 13 is located about the crane, the display 43 may be subdivided into different windows and/or different displays.

The recharging interface 36 operates to recharge the batteries in the cable warning devices 4 periodically. In some embodiments, the cable warning devices incorporate lithium ion batteries which have a high charge density. One or more retractable recharge cables may be coupled from the main body of the crane to the cable warning devices 4 on a periodic basis to replace the batteries. Alternatively, the batteries may be manually replaceable with or without an option to plug the replaced batteries into a recharging station on the crane body. In the event of a low battery condition, the crane operator will be warned that the battery 23 in one or more of the crane warning devices 4 is low and needs to be recharged and/or replaced. The indication may occur on the display 43.

The audio processor 23 in the crane warning devices allows the operator to communicate with the workers. Where a microphone and speaker system is included in the warning devices, the operator can communicate with the workers manipulating the ball 3. Conventionally, a worker manipulating the ball must signal the operator visually with one hand. Modern cranes have the operator enclosed in a environmentally controlled enclosure making voice communication impractical. Accordingly, by including a sophisticated audio processor (e.g., and advanced two-way baby monitor) within the warning devices (such as the one in the ball or on the counter weight) and one within the cabin 7, the crane operator may have two way communication with the workers. In this manner, worker safety is vastly increased because the worker may use both hands manipulate the load while verbally signaling the operator. The communication device also improves over radio communications since neither the operator or the workman have to carry or wear a radio. Further, the speaker and microphone are always present in the ball further improving safety. Further, by building the audible device into the ball of the crane, the workers do not have to utilize one hand to operate hand-held radios or other communication devices. Where both a camera and an audio processor are utilized, the combination of theses devices taken together, vastly increases safety and efficiency of the crane operating environment over either device used individually.

The audio processor may be further configured to electronically filter the noise from the crane's audible warning device so as not to interfere with normal communication with the crane operator. This filtering is done to filter out the beeping or tones emitted from the warning device without filtering out the normal voice of the operator and/or worker. Where the beeping noise occurs at a predetermined frequency, an electronic filter in the audio processor may be utilized to eliminate or severely attenuate the warning noise such that the operator can easily communicate with the workers. The verbal communication to each of the warning devices further enhances safety in that the operator has immediate communications with all sides of the crane. For example, where another worker notices a safety concern, he can communicate with the operator using any one of the cable warning devices 4.

Communications between the various motion sensors, warning devices 4, and/or central control device 11 may be accomplished using any suitable mechanism such as transmitter/receiver devices 24, 49. For example, the devices may communicate using electromagnetic waves such as radio waves. In some embodiments, a radio frequency in the range of about 900 MHz may be utilized to communicate between the warning device coupled to the ball and the warning device coupled to other portions of the crane. Suitable error correction codes, loss of signal detection, and channel hopping may be incorporated into the transmitter/receiver devices 24, 49 to increase safety and reliability. In the event of loss of communications, the warning devices 4 and/or central control device may be programmed to sound an alarm. In still further aspects of the crane warning system 1, fail-safe mechanisms may be built into the crane warning device such that the warning device is activated whenever a sensor fails or looses contact (e.g., radio contact) with the warning device. Further, a crane warning device status monitor may be built into the cabin of the crane so that the operator may be warned of any operational problems with any of the sensors in a timely fashion.

While an exemplary crane warning devices embodying the present invention are shown, it will be understood, of course, that the invention is not limited to these embodiments. Modifications may be made by those skilled in the art, particularly in light of the foregoing teachings. It is, therefore, intended that the appended claims cover any such modifications which incorporate the features of this invention or encompass the true spirit and scope of the invention. For example, each of the elements and/or steps of the aforementioned embodiments may be utilized alone or in combination with other elements and/or steps from other embodiments.

I claim:

1. A crane warning device comprising:

a perceptible warning signal;

a sensor, including an acceleration sensor, configured for detecting motion of a ball of a crane and actuating the perceptible signal responsive to the motion.

2. The crane warning device of claim 1 wherein the sensor includes a motion sensor.

3. The crane warning device of claim 1 wherein the sensor includes a hydraulic sensor.

4. The crane warning device of claim 3 where the hydraulic sensor is coupled to the warning device via radio waves.

5. The crane warning device of claim 1 wherein the sensor is coupled to a control system o the crane.

6. The crane warning device of claim 1, wherein the sensor is further configured to detect a constant velocity of the ball.

7. A crane warning system comprising a crane ball including a crane warning device having a microphone for communicating sounds from the crane ball to a crane operator.

8. The crane warning system of claim 7 wherein the crane warning device includes a beacon light visible from substantially all sides.

9. The crane warning system of claim 7 including a central control device in electromagnetic communication with the crane warning device.

10. The crane warning system of claim 9 wherein the central control device includes a microphone and speaker and the crane warning device further includes a speaker allowing two-way communication between the crane warning device and the central control device.

11. A method comprising:

actuating an electronic warning indicator coupled to a ball of a crane responsive to movement of the ball, including generating a first type of warning responsive to the ball moving up and generating a second type of warning different from the first type of warning responsive to the ball moving down.

12. The crane warning device of claim 11, wherein the first type of warning comprises a first audio frequency and the second type of warning comprises a second audio frequency different from the first audio frequency.

13. A crane warning system comprising a crane ball, the crane ball including a sensor for ultrasonically detecting a relative distance of the crane ball from a predetermined portion of a crane in order to provide a warning to a crane operator indicating a position of the crane ball with respect to the predetermined portion of the crane.

14. A crane warning system comprising a crane ball, the crane ball including a sensor for determining a twisting of the crane ball in order to provide a warning to a crane operator regarding twisting of the crane ball.

15. A ball for a crane having a cab to house a crane operator the ball comprising a speaker, and a microphone, the microphone and the speaker together being configured to allow two-way communication between a person proximate to the ball and a crane operator.

* * * * *